US007764922B2

(12) United States Patent
Sasama

(10) Patent No.: US 7,764,922 B2
(45) Date of Patent: Jul. 27, 2010

(54) IMAGE FORMING APPARATUS WITH PRINTED-PAPER STORING FUNCTION AND PRINTED-PAPER STORING METHOD THEREOF

(75) Inventor: Kazuo Sasama, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 698 days.

(21) Appl. No.: 11/674,832

(22) Filed: Feb. 14, 2007

(65) Prior Publication Data

US 2008/0193182 A1 Aug. 14, 2008

(51) Int. Cl.
*G03G 15/00* (2006.01)
*G03G 21/00* (2006.01)

(52) U.S. Cl. ..... 399/405; 399/381; 399/361

(58) Field of Classification Search ..... 399/361, 399/363, 381, 405; *G03G 15/00, 21/00*
See application file for complete search history.

(56) References Cited

U.S. PATENT DOCUMENTS

| | | | | |
|---|---|---|---|---|
| 4,470,356 | A * | 9/1984 | Davis et al. | 109/24.1 |
| 5,342,034 | A * | 8/1994 | Mandel et al. | 270/58.08 |
| 6,628,198 | B2 * | 9/2003 | Fieschi et al. | 340/568.1 |
| 2004/0136736 | A1 * | 7/2004 | Inaba | 399/38 |
| 2005/0010809 | A1 * | 1/2005 | Hayano | 713/200 |
| 2006/0220308 | A1 * | 10/2006 | Schaefer et al. | 271/298 |

FOREIGN PATENT DOCUMENTS

| | | | |
|---|---|---|---|
| GB | 2282923 | A * | 4/1995 |
| JP | 60258058 | A * | 12/1985 |
| JP | 02186429 | A * | 7/1990 |
| JP | 07-131620 | | 5/1995 |
| JP | 07131620 | A * | 5/1995 |
| JP | 2004223989 | A * | 8/2004 |
| JP | 2004243581 | A * | 9/2004 |
| JP | 2004-338295 | | 12/2004 |
| JP | 2006035531 | A * | 2/2006 |
| WO | WO 8301768 | A * | 5/1983 |

* cited by examiner

*Primary Examiner*—Judy Nguyen
*Assistant Examiner*—Wyn Q. Ha
(74) *Attorney, Agent, or Firm*—Turocy & Watson, LLP

(57) ABSTRACT

In a housing in which a printing unit is provided, a printed-paper storing unit that stores paper printed by the printing unit is provided to be removable to the outside. This printed-paper storing unit can be brought into a lock state in which removal to the outside of the housing is physically prevented by a fixing mechanism. When a print job sent from a user side designates internal storage of printed paper, the printed-paper storing unit is fixed in the housing by the fixing mechanism and locked. An unlock number of a number selected at random is notified to the user side to perform printing. After the printing is finished, the finish of the printing is notified to the user side and the lock state is released according to input of the unlock number to make it possible to remove printed paper to the outside.

18 Claims, 10 Drawing Sheets

IMAGE FORMING APPARATUS WITH PRINTED-PAPER STORING FUNCTION AND PRINTED-PAPER STORING METHOD THEREOF

BACKGROUND OF THE INVENTION

1. Field of the Invention

The present invention relates to an image forming apparatus with a function of storing printed-paper such as a confidential document and a printed-paper storing method thereof.

2. Description of the Related Art

In general, it is widely performed to transmit print data from a computer (hereinafter referred to as PC) used by a user to a printer via a network and print this print data on paper with the printer. In such a printer system, a normal print output, i.e., printed paper, is discharged from the printer in a state in which anyone can arbitrarily acquire the paper.

In many cases, the printer is commonly used for plural users. In this case, even when a certain user does not want the other users to look at a print output requested by the user, since the print output is discharged in a state in which anyone can acquire the print output, the other users can easily look at contents of the print output.

In order to solve such a problem, in JP-A-7-131620, a constitution in which only a user who requested printing can acquire a print result is disclosed. Printed paper is stored in a discharged paper storing unit, which is in a removal disallowed state, to keep the paper in a confidential state. Time when it is possible to acquire the paper is notified from a printer side to the user side who requested printing. When the user acquires a print result, the user inputs a user code at this notified time. On the printer side, the user code is collated with a user code registered in advance and, when the user codes coincide with each other, the discharged paper storing unit is brought into a removable state to permit the user to take out the printed paper in the confidential state.

In the system described above, in order to store printed paper, the user has to register the user code every time the user stores printed paper. Thus, handling operation is complicated. There are problems that should be solved. For example, a request for printing a number exceeding the number of pieces of stored paper cannot substantially be treated.

DETAILED DESCRIPTION OF THE INVENTION

An embodiment of the invention will be hereinafter explained in detail with the drawings as examples.

Figure 1:
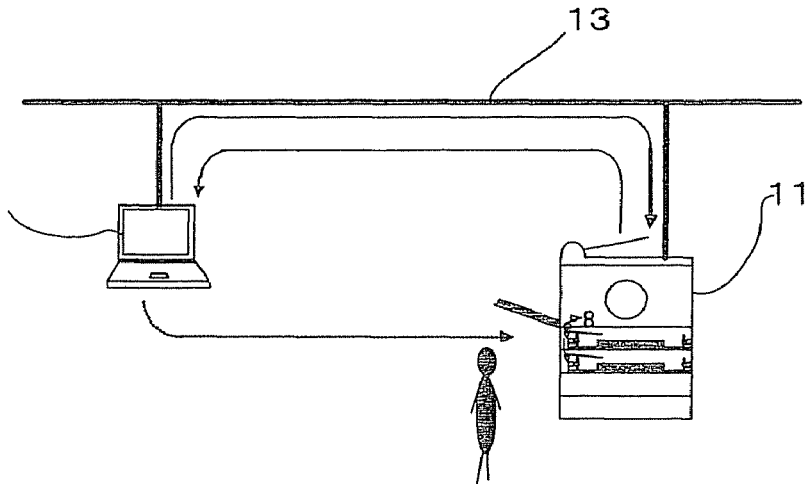
FIG. 1 is a system diagram schematically showing a relation between an image forming apparatus according to a first embodiment of the invention and a user side apparatus.

FIG. 1 schematically shows a relation between an image forming apparatus (hereinafter referred to as MFP) 11 according to a first embodiment of the invention and a computer (hereinafter, PC) 12 arranged on a user side. The MFP 11 is used as a printer. The MFP 11 and the PC 12 on the user side are connected to each other by a network 13 such as a LAN.

The PC 12 transmits a print job including print data to the MFP 11 through the network 13 according to operation by a printing person (a user). The MFP 11 accepts this print job and performs printing in accordance with the print data.

Figure 2:
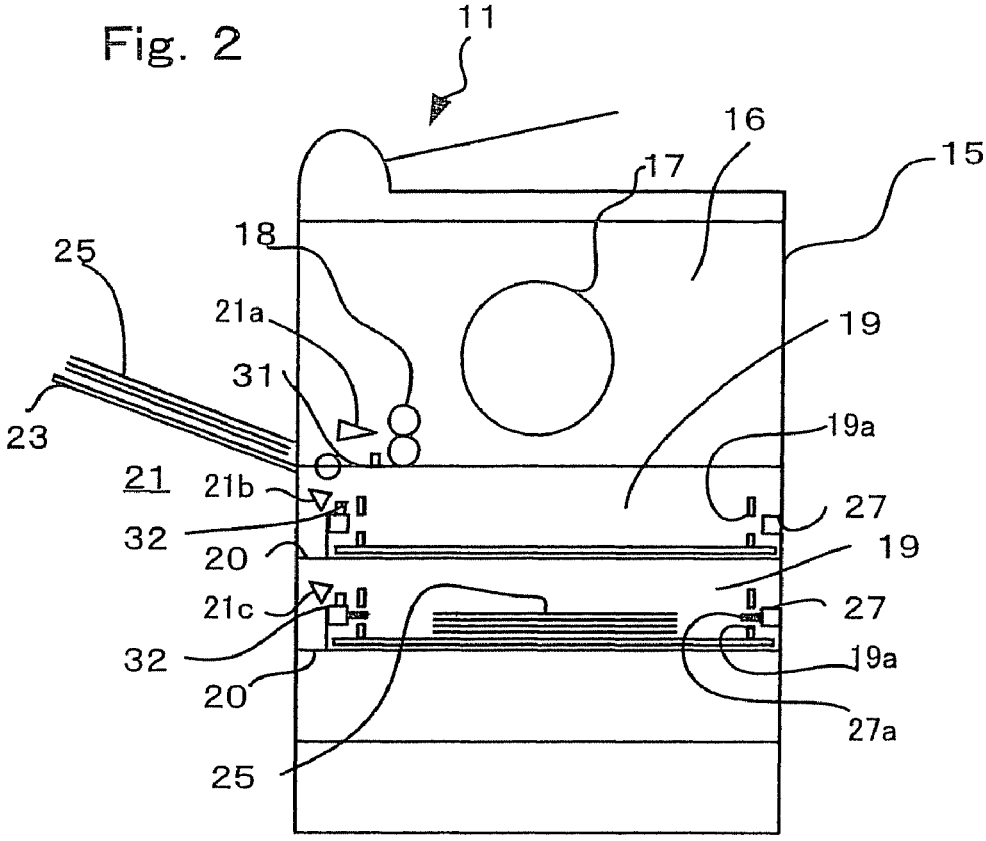
FIG. 2 is a diagram showing an internal structure of an image forming apparatus having a printed-paper storing function according to the first embodiment of the invention.

A structure of the MFP 11 will be explained with reference to FIG. 2. Reference numeral 15 denotes a housing, which constitutes an apparatus main body of the MFP 11. Reference numeral 16 denotes a printing unit, which is provided in an upper part in the housing 15. Although not explained in detail, the printing unit 16 has a photoconductive drum 17, a heat roller 18, and the like. Reference numeral 19 denotes printed-paper storing units formed in a tray shape. The printed-paper storing units 19 are removably provided on shelf units 20 formed in plural stages in the housing 15. The paper storing units 19 take paper printed by the printing unit 16 into the inside thereof with a guiding mechanism 21 described later.

The guiding mechanism 21 has a first selection plate 21*a*, a second selection plate 21*b*, a third selection plate 21*c*, and the like. The first selection plate 21*a* guides paper printed by the printing unit 16 and delivered from the heat roller 18 to a standard paper discharge tray 23 not requiring storage or a lower part shown in the figure where the paper storing units 19 are located. The second selection plate 21*b*, the third selection plate 21*c*, and the like guide printed paper guided downward by the first selection plate 21*a* into the paper storing units 19 corresponding thereto. Reference numeral 25 in the figure denotes printed paper and indicates a state in which the printed paper is stored on the standard paper discharge tray 23 and the paper storing units 19.

Reference numeral 27 denotes fixing mechanisms. The fixing mechanisms 27 can fix the paper storing units 19 in the housing 15 and set the paper storing units 19 in a lock state in which the paper storing units 19 is physically prevented from being removed to the outside of the housing 15. As the fixing mechanisms 27, for example, electromagnetic solenoids only have to be used. The electromagnetic solenoids 27 have pin-shaped actuators 27*a*. When the electromagnetic solenoids 27 are not excited, the actuators 27*a* project and move forward according to a force of a not-shown spring and fit in engaging holes 19*a* formed in side plates of the paper storing units 19. In this fit state, the paper storing units 19 come into the lock state in which the paper storing units 19 are physically prevented from being removed to the outside of the housing 15. On the other hand, when the electromagnetic solenoids 27 are excited, the actuators 27*a* move backward according to an electromagnetic force and the fitting with the engaging holes 19*a* is released. According to this release of fitting, it is possible to remove the paper storing units 19 to the outside of the housing 15.

In this way, since the paper storing units 19 are prevented from being removed to the outside by the fixing mechanisms 27. Thus, it is possible to prevent printed paper stored in the inside thereof from being stolen. Therefore, the paper storing units 19 will be hereinafter explained as theft prevention paper discharge trays 19.

Figure 3:
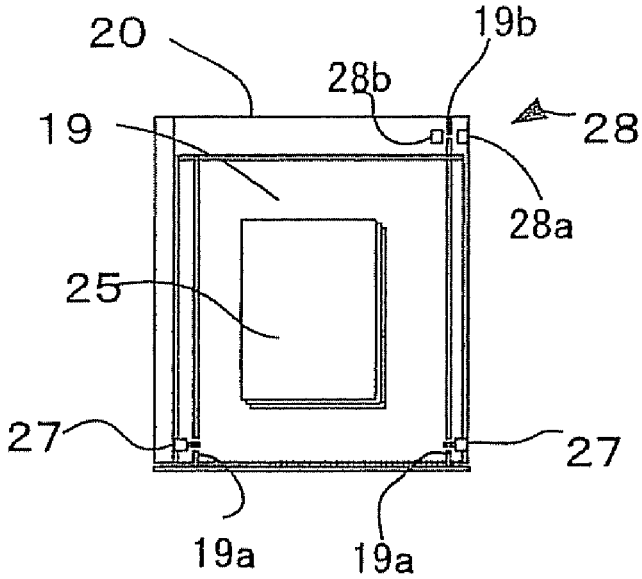
FIG. 3 is a plan view of a paper storing unit of the image forming apparatus according to the first embodiment of the invention.
Figure 4:
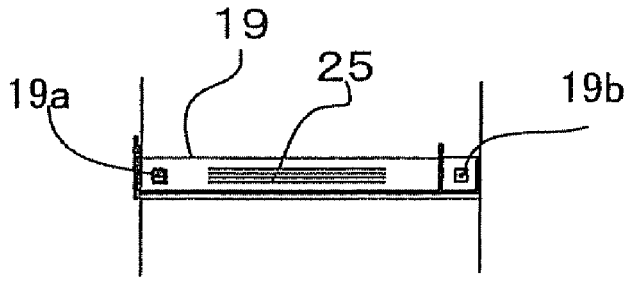
FIG. 4 is a side view of the paper storing unit of the image forming apparatus according to the first embodiment of the invention.

FIGS. 3 and 4 are a plan view and a side view showing a setting state of the theft prevention paper discharge tray 19 in the housing 15. In FIGS. 3 and 4, reference numeral 28 denotes a removal detecting unit, which detects that the theft prevention paper discharge tray 19 is removed to the outside of the housing 15. As this removal detecting unit 28, it is sufficient to use a unit in which a light emitting element 28*a* and a light receiving element 28*b* such as LED are arranged to be opposed to each other via a through hole 19*b* formed in a side plate of the theft prevention paper discharge tray 19. When the theft prevention paper discharge tray 19 is constituted in this way, if the theft prevention paper discharge tray 19 is set in a predetermined position in the housing 15, light of the light emitting element 28*a* is received by the light receiving element 28*b* through the through hole 19*b*. However, when the theft prevention paper discharge tray 19 is removed from the housing 15, since the light receiving element 28*b* is blocked from light, according to this light blocking operation, the removal detecting unit 28 detects that the theft prevention paper discharge tray 19 is removed to the outside of the housing 15.

Figure 5:
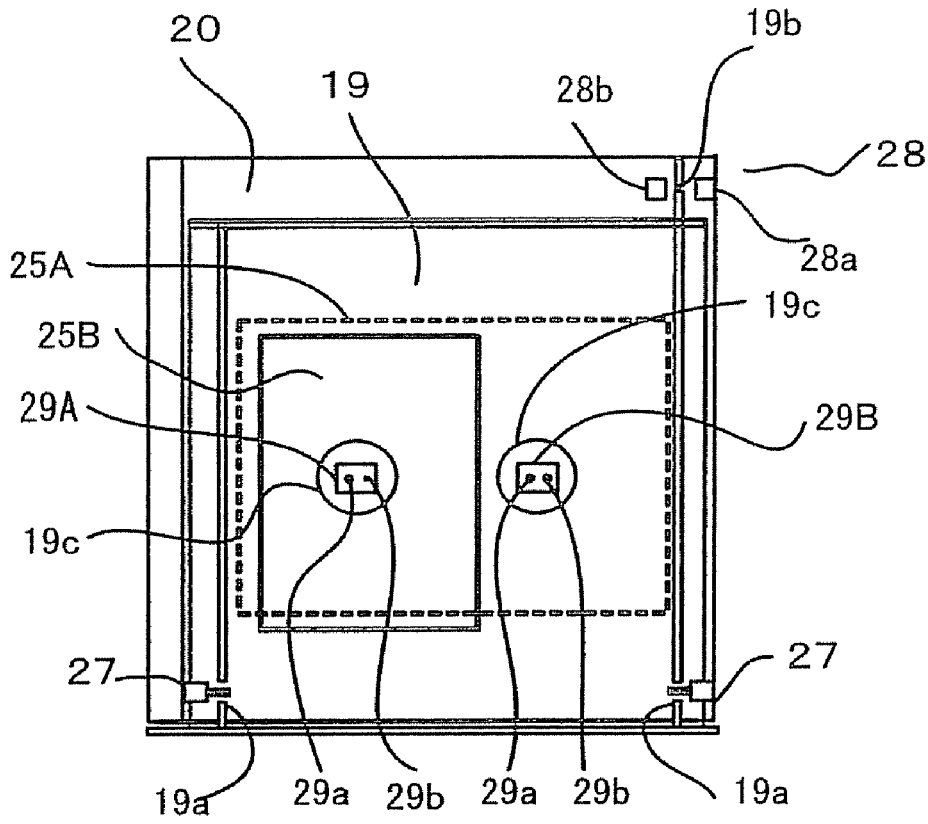
FIG. 5 is a plan view showing the paper storing unit of the image forming apparatus according to the first embodiment of the invention in enlargement.
Figure 6:
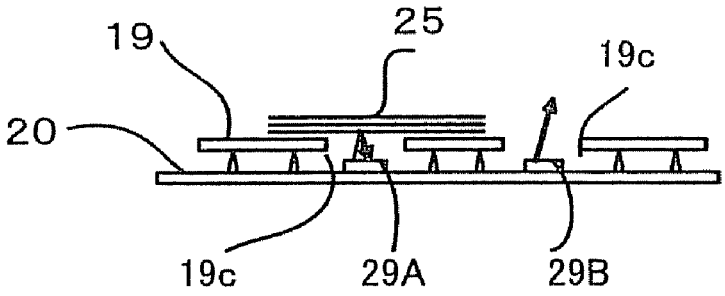
FIG. 6 is a front view showing a bottom section of the paper storing unit of the image forming apparatus according to the first embodiment of the invention in enlargement.

FIGS. 5 and 6 are a plan view and a front view showing a relation between the theft prevention paper discharge tray 19 and paper sensors 29. In FIGS. 5 and 6, the paper sensors 29 are set on the shelf unit 20 of the housing 15. The paper sensors 29 detect present or absence of printed paper 25 on the theft prevention paper discharge tray 19 through an opening 19*c* formed in a bottom surface of the theft prevention paper discharge tray 19. As the paper sensors 29, for example, sensors of a light reflection type including light emitting elements 29*a* and light receiving elements 29*b* are used. In this case, when the printed paper 25 is on the paper sensors 29, light from the light emitting elements 29*a* is reflected on the printed paper 25 and inputted to the light receiving elements 29*b*. The paper sensors 29 detect that the paper 25 is in the paper storing unit 19. When the printed paper 25 is not on the paper sensors 29, since reflected light is not inputted to the light receiving elements 29*b*, the paper sensors 29 detect that there is no paper.

In the figure, two paper sensors 29A and 29B are provided. This is because there are plural sizes of the printed paper 25. Since paper 25A of a size A has a large area, both the two paper sensors 29A and 29B detect presence of paper. On the other hand, since paper 25B of a size B has a small area, one paper sensor 29A detects presence of paper but the other paper sensor 29B does not detect presence of paper. In this way, even if there are plural sizes of the printed paper 25, it is possible to detect presence of paper with the paper sensor 29A or 29B.

The paper sensors that use reflected light are described as an example of the paper sensors 29. However, it is possible to use any sensor as long as the sensor can reflect and detect light. For example, it is also possible to use an ultrasonic sensor that uses a reflected wave.

Figure 12:
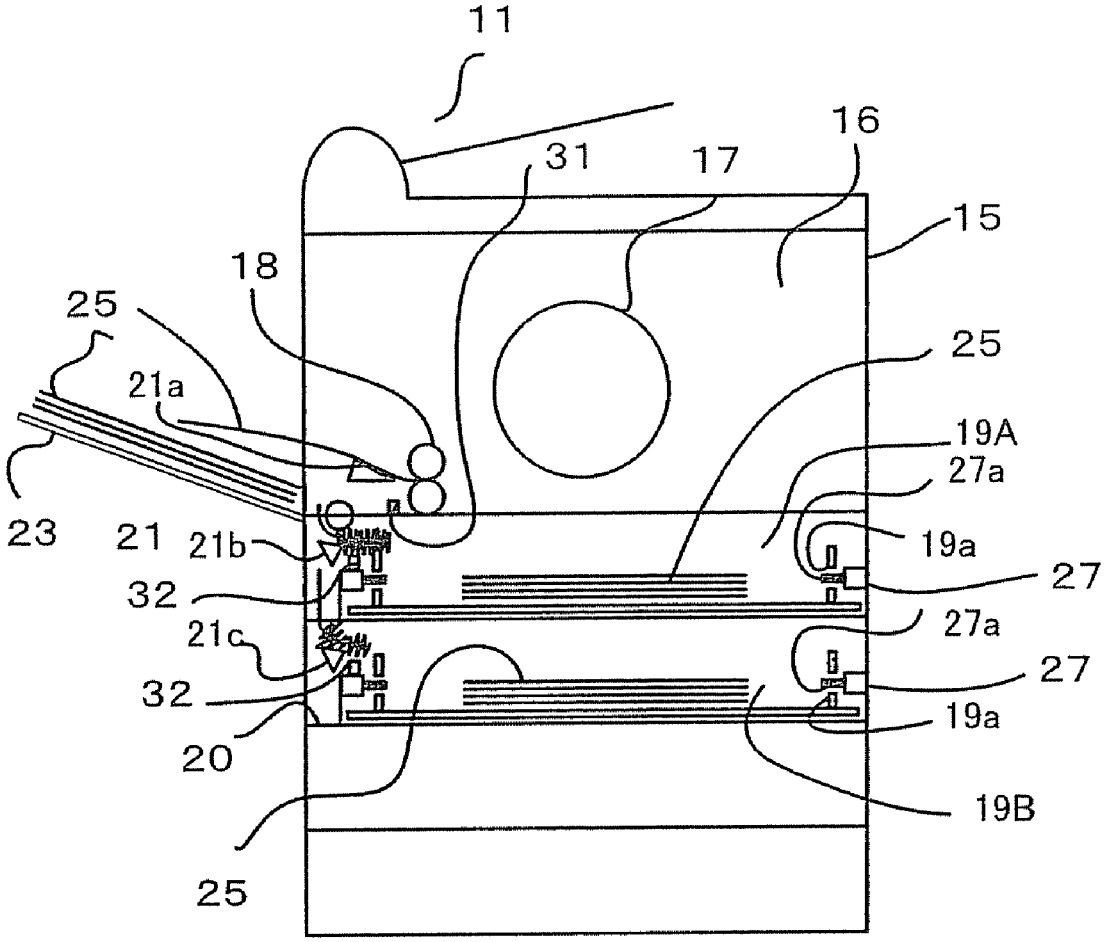
FIG. 12 is an internal diagram for explaining a paper jam occurrence state of the image forming apparatus according to the first embodiment of the invention.

Referring back to FIG. 2, reference numeral 31 denotes a first jam sensor. The first jam sensor 31 is provided on an exit side of the heat roller 18 of the printing unit 16 and detects a jam of printed paper in this section. Reference numeral 32 denotes second jam sensors. The second jam sensors 32 are provided in entrance sections of the theft prevention paper discharge trays 19 on the respective shelf units 20 in which the theft prevention paper discharge trays 19 are provided. As shown in FIG. 12, the second jam sensors 32 detect a jam of printed paper in the entrance sections.

Figure 7:
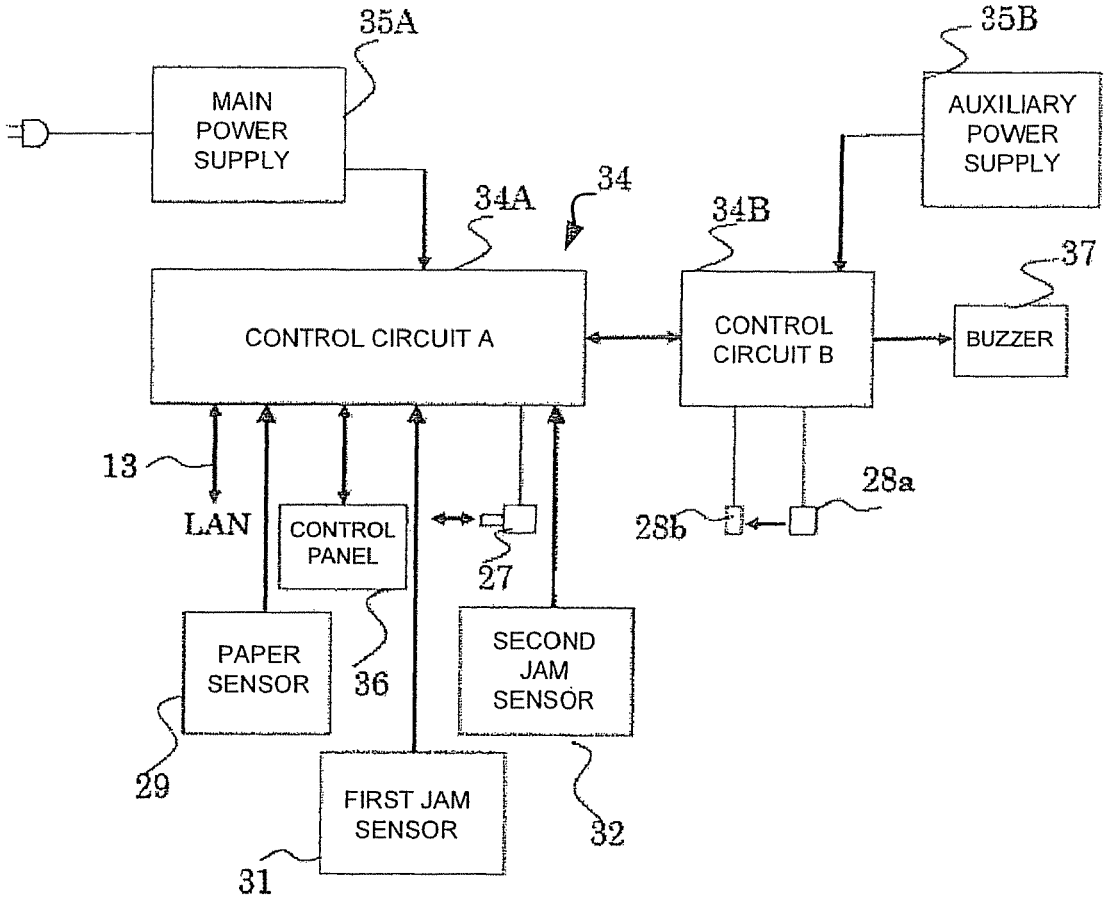
FIG. 7 is a block diagram showing a structure of a control section of the image forming apparatus according to the first embodiment of the invention.

FIG. 7 is a block diagram showing a structure of a control unit of the MFP 11. In FIG. 7, a control unit 34 includes a first control circuit 34A and a second control circuit 34B. The first control circuit 34A receives supply of electric power from a main power supply 35A and the second control circuit 34B receives supply of electric power from an auxiliary power supply 35B. The main power supply 35A supplies electric power to a main body unit including the printing unit 16 shown in FIG. 2. A normal commercial power supply is used as the main power supply 35A. The auxiliary power supply 35B is a power supply device capable of supplying electric power even if the main power supply 35A is turned off. The auxiliary power supply 35 is constituted by a battery or a storage battery.

The first control circuit 34A is connected to the network 13 shown in FIG. 1 and exchanges various kinds of information described later with the PC 12 on the user side via this network 13. The first control circuit 34A is also connected to the electromagnetic solenoids 27 serving as the fixing mechanisms shown in FIG. 2 and controls excitation to the electromagnetic solenoids 27. The first control circuit 34A is also connected to the paper sensor 29 shown in FIGS. 5 and 6 and the first jam sensor 31 and the second jam sensor 32 shown in FIG. 2 and inputs detection signals of these sensors. Moreover, the first control circuit 34A is connected to the control panel 36 provided in the main body of the printer 11 and inputs various operation signals to the control panel 36 and outputs various display signals.

A voltage for the main power supply 35A is generated from a commercial AC outlet. The main power supply 35A supplies electric power to the first control circuit 34A. The first control circuit 34A controls ON and OFF of voltage application to the electromagnetic solenoids 27 that fixes the theft prevention paper discharge trays 19. Further, the first control circuit 34A performs control for input of an unlock number (an ID number) described later by the printing person (the user) from the control panel 36, control of various kinds of transfer including a print job to the PC 12, and the like. It goes without saying that the first control circuit 34A has a function of print control and the like for the main body of the MFP 11.

When the AC outlet is disconnected, the supply of electric power from the main power supply 35A to the first control circuit 34A is stopped and the control function stops. According to the stop of the supply of electric power to the first control circuit 34A, a voltage is not applied to the electromagnetic solenoids 27. The fixing mechanisms that use the solenoids 27 come into a lock state.

The first control circuit 34A notifies the second control circuit 34B of a state change (ON to OFF and OFF to ON) of the electromagnetic solenoids 27. The second control circuit 34B recognizes a state (ON or OFF) of the electromagnetic solenoids 27, i.e., a lock state or an unlock state of the theft prevention paper discharge trays 19.

The second control circuit 34B exchanges various signals with the first control circuit 34A. The second control circuit 34B is connected to the light emitting element 28*a* and the light receiving element 28*b* of the removal detecting unit 28 shown in FIGS. 3 and 5 and inputs a removal detection signal. Moreover, the second control circuit 34B is connected to an alarm device 37 such as a buzzer and causes this alarm device 37 to operate.

When the theft prevention paper discharge tray 19 is in the lock state, the removal detecting unit 28 connected to the second control circuit 34B is in a state in which light of the light emitting element 28*a* can be received by the light receiving element 28*b*. When the theft prevention paper discharge tray 19 is forcibly pulled out from the main body, the light receiving element 28*b* cannot receive light from the light emitting element 28*a*. The second control circuit 34B recognizes the risk of theft because the light receiving element 28*b* cannot receive light and performs control for sounding the buzzer or the like of the alarm device 37.

When the theft prevention paper discharge tray 19 is in the unlock state, the second control circuit 34B does not perform control for sounding the buzzer regardless of whether the light receiving element 28*b* can receive light.

Functions of the control unit 34 including the first control circuit 34A and the second control circuit 34B will be explained.

The control unit 34 accepts a print job sent from the PC 12 on the user side via the network 13. When this print job designates internal storage of a print result, the control unit 34 operates as follows in order to store printed paper in the theft prevention paper discharge tray 19. First, the control unit 34 releases excitation to the electromagnetic solenoids 27 serving as the fixing mechanisms and brings the theft prevention paper discharge tray 19 into the lock state.

When the main power supply 35A is turned on during starting of the MFP 11, the electromagnetic solenoids 17 are automatically excited and the actuators 27*a* thereof come off the engaging holes 19*a* of the theft prevention paper discharge tray 19. Thus, the theft prevention paper discharge tray 19 is removable to the outside. Therefore, when internal storage of printed paper is designated by the print job, the control unit 34 releases excitation to the electromagnetic solenoids 27 in order to bring the theft prevention paper discharge tray 19 used for storage into the lock state. Therefore, the actuators 27*a* of the electromagnetic solenoids 27 fit in the engaging holes 19*a* of the theft prevention paper discharge tray 19 corresponding thereto with a not-shown spring force and bring this theft prevention paper discharge tray 19 into the lock state in which removal to the outside is physically prevented.

Subsequently, the control unit 34 selects a number at random to create an unlock number and notifies the PC 12 on the user side, which transmitted the print job, of this unlock number via the network 13. The control unit 34 causes the printing unit 16 to operate in accordance with the print data of the print job sent and executes printing. After the printing is finished, the control unit 34 notifies the PC 12 on the user side, which transmitted the print job, of the finish of the printing via the network 13. Moreover, when the unlock number is inputted to the control panel 36 by the user who receives the notification of the finish of the printing, the control unit 34 excites the electromagnetic solenoids 27 to release the lock state of the theft prevention paper discharge tray 19.

Lock operation applied to the theft prevention paper discharge tray 19 by the control unit 34, i.e., release of excitation of the electromagnetic solenoids 27 is performed only once for one print job when the number of prints designated in the print job is within the number of pieces of stored paper in one theft prevention paper discharge tray 19.

When the control unit 34 accepts plural print jobs that designate internal storage of a print result, the control unit 34 allocates one theft prevention paper discharge tray 19 for each of the print jobs. The control unit 34 releases excitation of the electromagnetic solenoids 27 of the theft prevention paper discharge trays 19, controls the theft prevention paper discharge trays 19 to be in the lock state, and brings the theft prevention paper discharge trays 19 into a use state. It is impossible to use the theft prevention paper discharge trays 19, which are brought into the use state, for other print jobs until the electromagnetic solenoids 27 corresponding thereto are excited and the lock state is released.

The control unit 34 has a function of detecting, when the theft prevention paper discharge tray 19 is forcibly removed to the outside because, for example, the actuator 27*a* of the electromagnetic solenoid 27 is broken, the removal of the theft prevention paper discharge tray 19 and sounding an alarm. When the removal detecting unit 28 detects removal of the theft prevention paper discharge tray 19 to the outside of the housing 15, if this theft prevention paper discharge tray 19 is in the lock state, the control unit 34 sounds the alarm device 37. When the theft prevention paper discharge tray 19 is removed to the outside despite the fact that the theft prevention paper discharge tray 19 is in the lock state, this means that the fixing mechanisms by the electromagnetic solenoids 27 and the like were broken and the theft prevention paper discharge tray 19 was forcibly removed to the outside. Thus, the control unit 34 sounds an alarm to call the user's attention.

In this case, the second control circuit 34B shown in FIG. 7 has acquired information for monitoring an applied voltage to the electromagnetic solenoids 27 from the first control circuit 34A and determines whether the theft prevention paper discharge tray 19 is in the lock state. When the theft prevention paper discharge tray 19 is in the lock state, the second control circuit 34B lights the light emitting element 28*a* of the removal detecting unit 28 and monitors presence or absence of light reception in the light receiving element 28*b*. When the light receiving element 28*b* stops receiving light, the second control circuit 34B sounds the buzzer or the like of the alarm device 37 to perform warning.

Here, electric power is supplied to the removal detecting unit 28 and the alarm device 37 from the auxiliary power supply 35B constituted by a battery or a storage battery, which is different from the main power supply 35A, by the second control circuit 34B. Therefore, when it is attempted to turn off the main power supply 35A to steal printed paper, since the alarm device 37 is actuated by the auxiliary power supply 35B, it is possible to maintain the theft prevention function.

Even if a print job designates the number of prints exceeding the number of pieces of stored paper in the theft prevention paper discharge tray 19, the control unit 34 can perform printing without causing overflow of printed paper from the theft prevention paper discharge tray 19. In this case, the control unit 34 notifies the PC 12, which transmitted this print job, that the number of prints of this print job is a value exceeding the number of pieces of stored paper in the theft prevention paper discharge tray 19 via the network 13. When the number of prints is counted and the number of prints reaches a predetermined number of pieces of paper (a set value within the number of pieces of stored paper in the theft prevention paper discharge tray 19), the control unit 34 notifies the PC 12, which transmitted this print job, to that effect via the network 13 and urges the user to take out the printed paper from the theft prevention paper discharge tray 19.

Moreover, when the number of prints reaches the predetermined number of pieces of paper, the control unit 34 stops the printing once. When the user inputs the unlock number notified in advance to the control panel 36 according to the notification that the number of prints has reached the predetermined number of pieces of paper, the control unit 34 excites the electromagnetic solenoids 27 corresponding to the theft prevention paper discharge tray 19 to release the lock state of the theft prevention paper discharge tray 19. The user can remove the theft prevention paper discharge tray 19 corresponding thereto to the outside of the housing 15 and remove stored paper from the theft prevention paper discharge tray 19. After this, when the user inserts the theft prevention paper discharge tray 19 to a predetermined position in the housing 15 again, the control unit 34 confirms with the paper sensor 29 that printed paper is not present in this theft prevention paper discharge tray 19. As a result, when paper is not present, the control unit 34 stops the excitation of the electromagnetic solenoids 27 corresponding thereto and brings the theft prevention paper discharge tray 19 corresponding thereto into the lock state again to resume printing.

When a jam occurs in the MFP 11, the control unit 34 can continue a part of printing depending on a location of occurrence of the jam and conditions. In other words, if a portion is in a printable state, rather than always stopping the entire printing, the control unit 34 continues printing of that portion. For example, it is assumed that a jam has occurred during execution of plural print jobs for storing printed paper in the theft prevention paper discharge trays 19 corresponding thereto, respectively. In the case, when it is found that a jam has not occurred in the printing unit 16 or a jam in the printing unit 16 is removed according to a result of detection by the first jam sensor 31, the control unit 34 determines from the result of detection by the second jam sensor 32 whether there is the theft prevention paper discharge tray 19 in which a jam has not occurred. As a result, when there is the theft prevention paper discharge tray 19 in which a jam has not occurred, the control unit 34 stops a print job that uses the theft prevention paper discharge trays 19 in which a jam has occurred but continues a print job that uses the theft prevention paper discharge tray 19 in which a jam has not occurred.

Moreover, when the control unit 34 accepts both a print job that designates internal storage of a print result and a normal print job that does not designate the internal storage of a print result, the control unit 34 alternately executes these print jobs for each predetermined number of pieces of paper. In this case, during execution of the print job that designates the internal storage of a print result, the control unit 34 causes the guiding mechanism 21 to guide printed paper to the theft prevention paper discharge tray 19 corresponding thereto. During execution of the normal print job, the control unit 34 switches the guiding mechanism 21 and causes the guiding mechanism 21 to guide printed paper onto the standard paper discharge tray 23 shown in FIG. 2.

An operation for guiding printed paper by the guiding mechanism 21 will be explained with reference to FIGS. 8 to 11.

Figure 8:
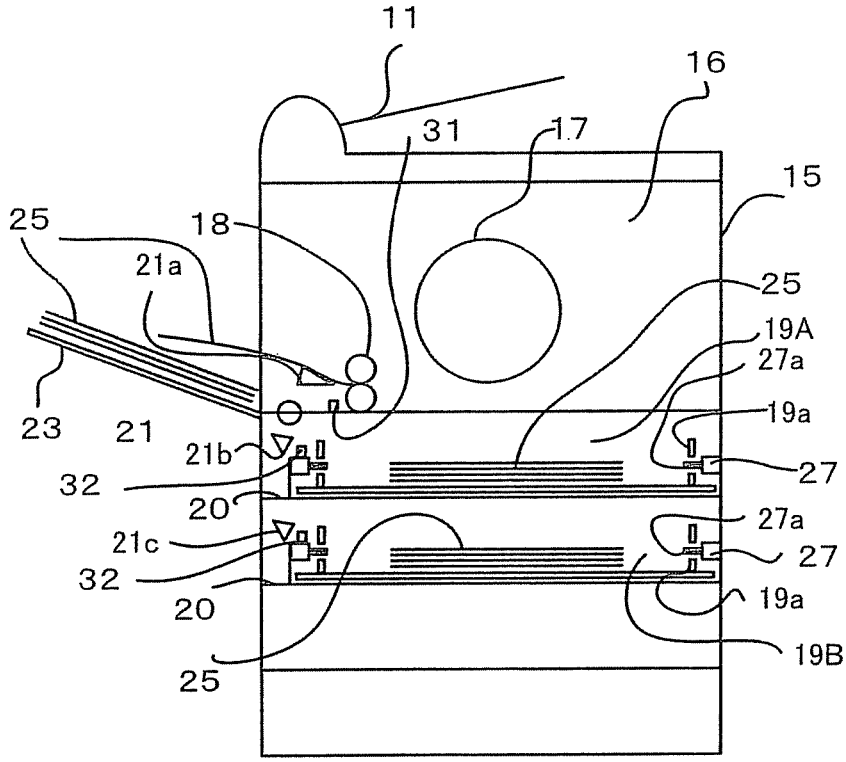
FIG. 8 is an internal diagram for explaining a paper path to a standard paper discharge tray of the image forming apparatus according to the first embodiment of the invention.

FIG. 8 shows a paper path at the time when printed paper 25 is outputted to the standard paper discharge tray 23 not requiring internal storage. In this case, the printed paper 25 that has passed the heat roller 18 is turned onto the standard paper discharge tray 23 and discharged by the first selection plate 21*a*, the tip (the right end in the figure) of which is rotated obliquely downward by a not-shown actuator.

Figure 9:
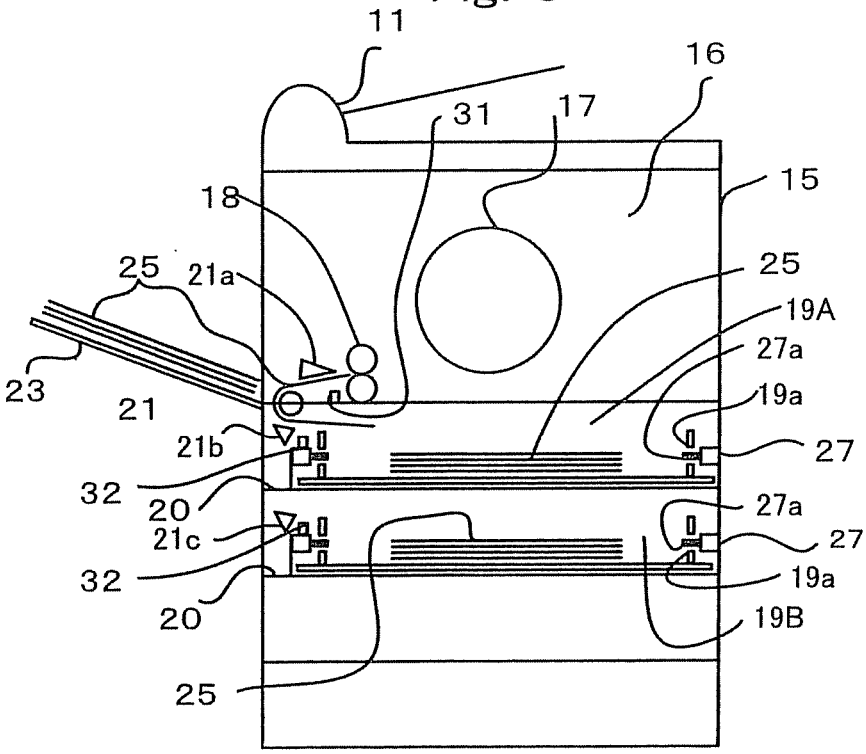
FIG. 9 is an internal diagram for explaining a paper path to a paper storing unit at an upper stage of the image forming apparatus according to the first embodiment of the invention.

FIG. 9 is a diagram showing a paper path at the time when the printed paper 25 is outputted to a theft prevention paper discharge tray 19A set on the shelf plate 20 at the uppermost stage in the housing 15. In this case, the printed paper 25 that has passed the heat roller 18 is turned to a tray below the standard paper discharge tray 23 by the first selection plate 21*a*, the tip (the right end in the figure) of which is rotated obliquely upward (substantially horizontally in the figure) by the not-shown actuator. The printed paper 25 turned is turned to the theft prevention paper discharge tray 19A set on the shelf plate 20 at the uppermost stage by the second selection plate 21*b* inclined to the left side in the figure by the not-shown actuator and is inserted into this theft prevention paper discharge tray 19A.

Figure 10:
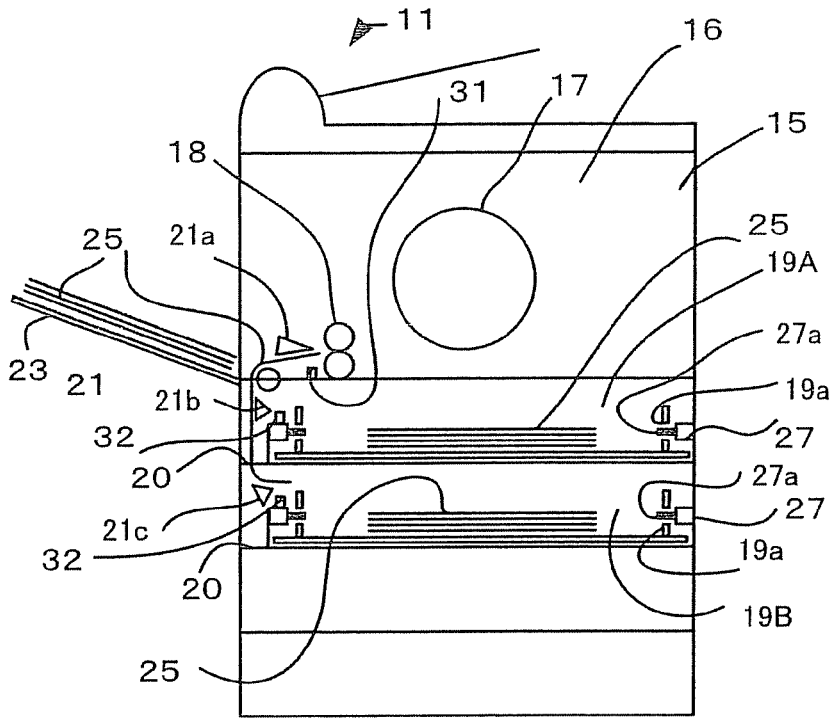
FIG. 10 is an internal diagram for explaining a paper path to a paper storing unit at the next stage of the image forming apparatus according to the first embodiment of the invention.

FIG. 10 is a diagram showing a paper path at the time when the printed paper 25 is outputted to a theft prevention paper discharge tray 19B set on the shelf plate 20 at the second stage in the housing 15. In this case, the printed paper 25 that has passed the heat roller 18 is turned to the tray below the standard paper discharge tray 23 by the first selection plate 21*a* as in the above case. Since a guide surface of the second selection plate 21*b* is set in the vertical state by the not-shown actuator, the printed paper 25 is guided further downward. Since a guide surface of the third selection plate 21*c* provided on the shelf plate 20 at the second stage is inclined to the left side in the figure by the not-shown actuator, the printed paper 25 sent from the above is turned to the theft prevention paper discharge tray 19B set on the shelf plate 20 at the second stage and is inserted into this theft prevention paper discharge tray 19B.

Figure 11:
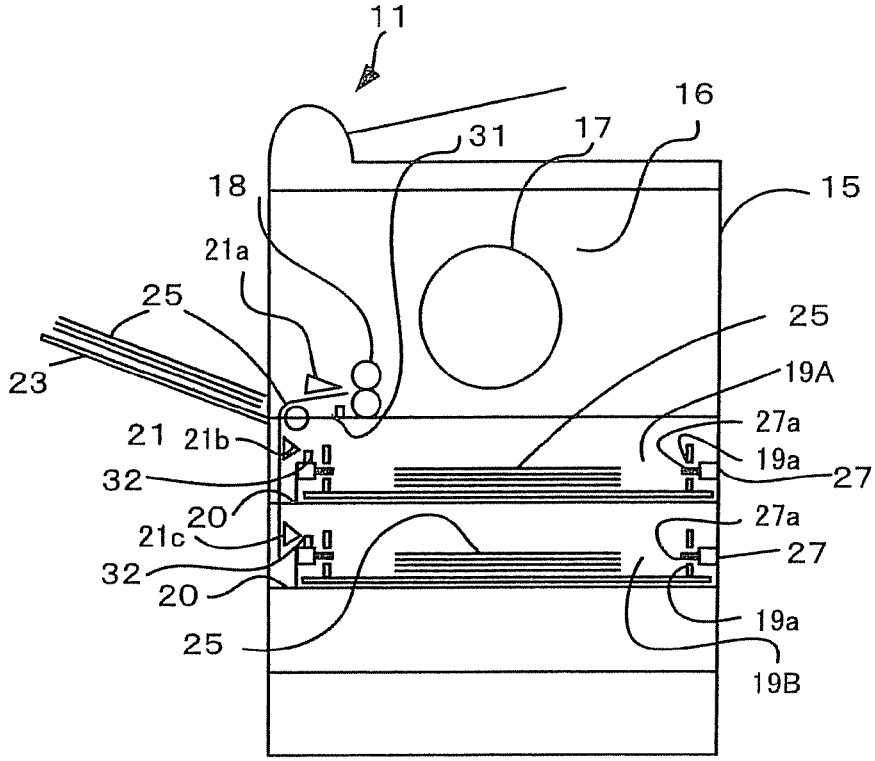
FIG. 11 is an internal diagram for explaining a paper path further downward than the paper storing unit at the next stage of the image forming apparatus according to the first embodiment of the invention.

FIG. 11 is a diagram showing a paper path at the time when the printed paper 25 is outputted to a paper storing unit (not shown) provided further below the shelf plate 20 at the second stage in the housing 15. In this case, the printed paper 25 that has passed the heat roller 18 is turned to the tray below the standard paper discharge tray 23 by the first selection plate 21*a* as in the case described above. Since the guide surfaces of both the second selection plate 21*b* and the third selection plate 21*c* are set in the vertical state by the not-shown actuator, the printed paper 25 is turned to a not-shown theft prevention paper discharge tray provided further below the tray.

In the constitution described above, the printing person (the user) transfers a print job from the PC 12 to the MFP 11. In this case, when printed paper is stored without being discharged to the outside, the printing person instructs storage during the print job. When the control unit 34 of the MFP 11 accepts the print job for storing the printed paper in the theft prevention paper discharge tray 19, the control unit 34 brings the theft prevention paper discharge tray 19 in use into the lock state and starts printing. At the same time, the control unit 34 issues an unlock number created at random to the personal computer and notifies the PC 12 of the unlock number through the network 13. The unlock number is encrypted and transferred on the network 13.

When the finish of the printing is notified from the MFP 11, the printing person checks the finish of the printing and inputs the unlock number notified in advance from the control panel 36. The control unit 34 checks the unlock number inputted and, if the unlock number is correct, releases the lock of the theft prevention paper discharge tray 19 corresponding thereto.

When the main power supply 35A is turned on during starting of the MFP 11, if no printed paper is left in the theft prevention paper discharge tray 19, a voltage is applied to the electromagnetic solenoids 27 as described above and the lock is released. However, if printed paper is left in the theft prevention paper discharge tray 19, a voltage is not applied to the electromagnetic solenoid 27 and the theft prevention paper discharge tray 19 continues to be locked. It is detected by the paper sensor 29 whether printed paper is left in the theft prevention paper discharge tray 19.

Operations will be hereinafter explained in detail using flowcharts in FIGS. 13 to 15.

The PC 12 performs setting of a print job on the MFP 11 (step 101). In this case, setting of selection of a paper discharge tray is performed on the PC 12 side (step 102). When the print job requires internal storage of printed paper, the PC 12 selects the theft prevention paper discharge tray 19. The PC 12 inquires the MFP 11, in a form of a request for securing a paper discharge tray, whether the theft prevention paper discharge tray 19 selected is in use or not in use (step 103). The PC 12 receives notification of a result of securing a paper discharge tray from the MFP 11 (step 104). As a result, when the paper discharge tray selected is successfully secured (step 105: Y), the PC 12 transmits print data to the MFP 11 (step 106). When the paper discharge tray is not successfully secured (step 105: N), the PC 12 repeats reselection of a paper discharge tray and securing of the paper discharge tray.

When the MFP 11 accepts the print data, the MFP 11 transmits an unlock number (hereinafter explained as ID number) formed by a number selected at random to the PC 12 (step 107). During transfer, the ID number is encrypted. The MFP 11 locks the theft prevention paper discharge tray 19 secured (step 108) and starts printing (step 109). Printed paper is outputted to the theft prevention paper discharge tray (step 110). When printing of all pieces of paper is finished (step 111: Y), the MFP 11 stops the printing (step 112) and notifies the PC 12 at the print request source of the finish of the printing (step 113).

The printing person who receives the print finish notification with the PC 12 inputs the ID number received before the printing from the control panel (CP) 36 in order to take out printed paper (step 114: Y) and releases the lock of the theft prevention paper discharge tray 19 (step 115). The printing person pulls out the theft prevention paper discharge tray 19 unlocked from the housing 15 and takes out printed paper from this paper discharge tray 19 (steps 116 and 117). After the printing person takes out the printed paper, when the printing person stores the theft prevention paper discharge tray 19 in the housing 15 again (step 118), the MFP 11 checks with the light emitting element 28*a* and the light receiving element 28*b* whether the theft prevention paper discharge tray 19 is securely stored in the housing 15 (step 119). If the theft prevention paper discharge tray 19 is properly stored, the MFP 11 detects with the paper sensor 29 whether printed paper is left in the theft prevention paper discharge tray 19 (step 120). When printed paper is not left in the theft prevention paper discharge tray, the printing is finished (step 124).

On the other hand, when printed paper is left in the theft prevention paper discharge tray 19 (step 120: N), after locking the theft prevention paper discharge tray 19 again (step 121), the MFP 11 displays, on the control panel (CP) 36, a request for taking out the printed paper from the theft prevention paper discharge tray 19 (step 122) and notifies the PC 12 at the print request source of the request for taking out the printed paper (step 123).

The printing person who has received the notification of the request for taking out the printed paper returns to step 114, inputs the ID number received before the printing from the control panel (CP) 36 again, and thereafter repeats the series of operation for taking out printed paper (steps 115 to 120). When no printed paper is left in the theft prevention paper discharge tray 19, the printing is finished (step 124).

Processing in the case in which the printing is not finished will be explained using FIG. 14.

Figure 13:
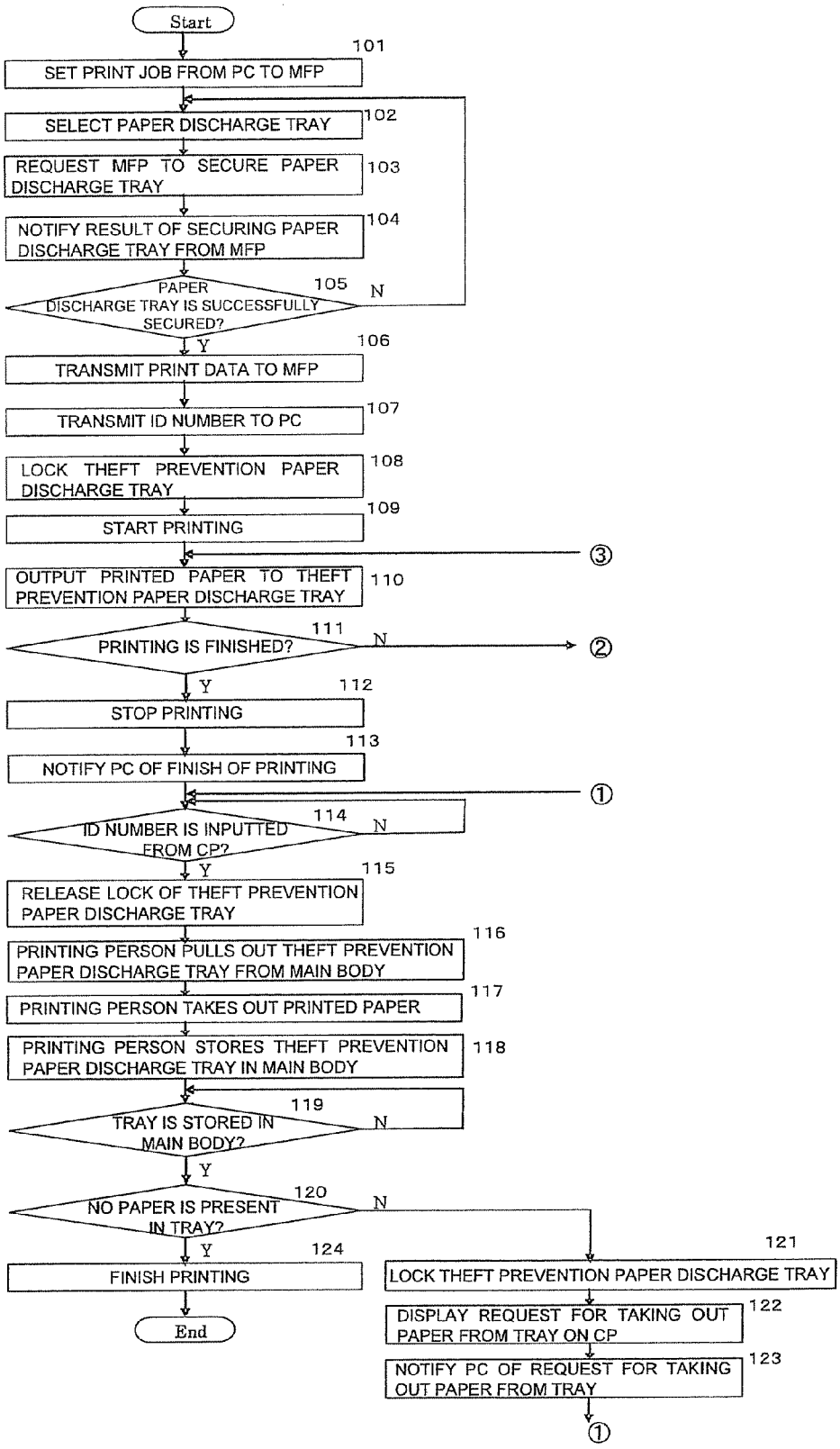
FIG. 13 is a flowchart for explaining a series of printing operations requiring paper storage of the image forming apparatus according to the first embodiment of the invention.
Figure 14:
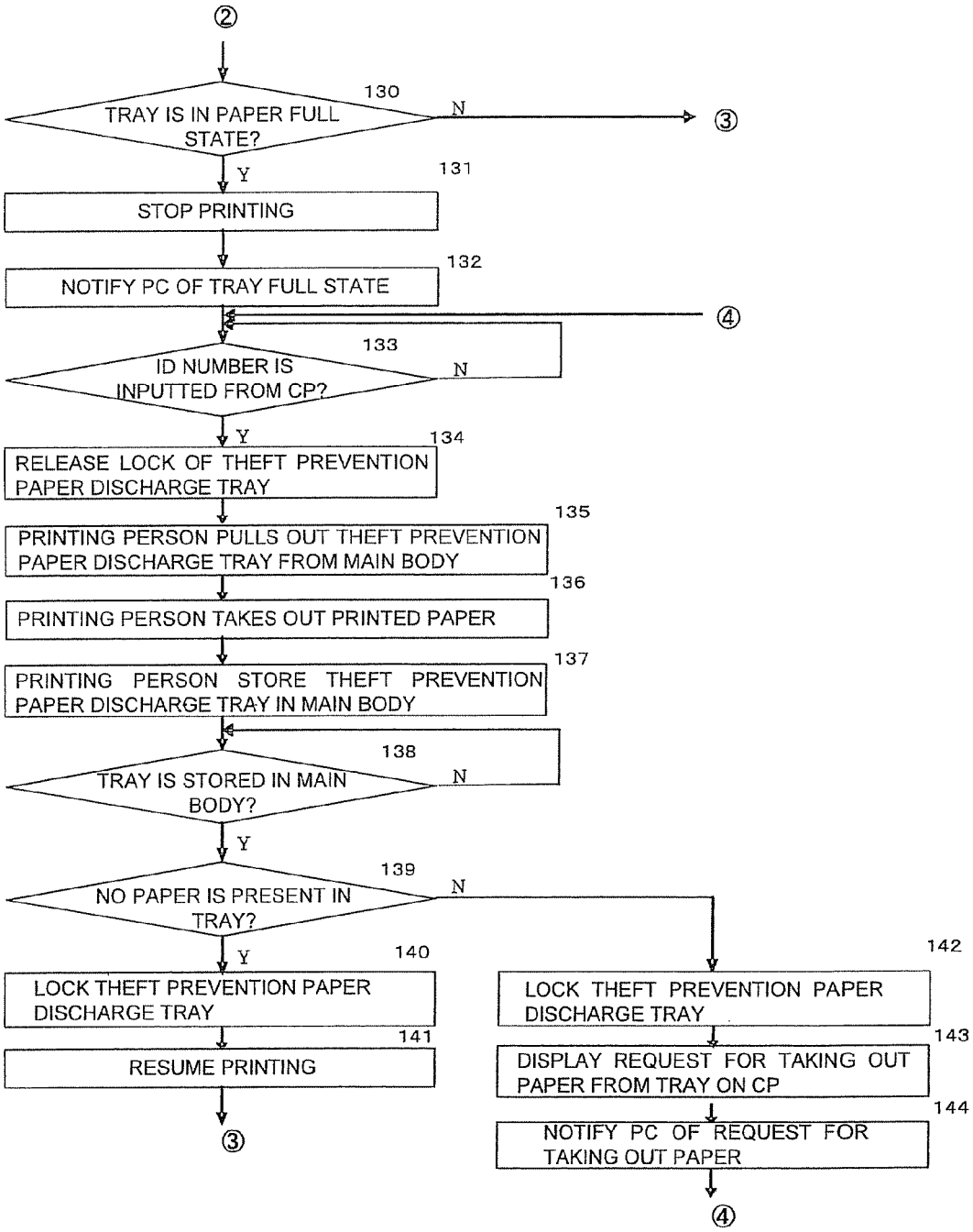
FIG. 14 is a flowchart for explaining a paper storing unit removal operation during printing in the series of printing operations requiring paper storage of the image forming apparatus according to the first embodiment of the invention.

When the printing is not finished in the determination in step 111 in FIG. 13 (step 111: N), the MFP 11 determines whether the theft prevention paper discharge tray 19 is in a full state in which the number of pieces of printed paper outputted to the theft prevention paper discharge tray 19 has reached a limit number of pieces of stored paper of the theft prevention paper discharge tray 19 (step 130). This determination is performed, in the control unit 34 of the MFP 11, by counting the number of prints outputted to the theft prevention paper discharge tray 19 using a not-shown counter and comparing the number of prints with a set value. When the theft prevention paper discharge tray 19 is not full (step 130: N), the MFP 11 returns to step 110 in FIG. 13 and continues the printing using the theft prevention paper discharge tray 19. On the other hand, when the theft prevention paper discharge tray 19 is full, the MFP 11 stops the printing (step 131) and notifies the PC 12 at the print request source of the full state.

The printing person who has received the notification that the theft prevention paper discharge tray 19 is in the full state inputs the ID number received before the printing to the control panel (CP) 36 of the MFP 11 (step 133). Consequently, since the lock of the theft prevention paper discharge tray 19 is released (step 134), the printing person pulls out the theft prevention paper discharge tray 19 from the housing 15 and takes out the printed paper (steps 135 and 136). Thereafter, the printing person stores the theft prevention paper discharge tray 19 in a predetermined position in the housing 15 again (step 137). The MFP 11 checks with the light emitting element 28*a* and the light receiving element 28*b* whether the theft prevention paper discharge tray 19 is surely stored in the predetermined position in the housing 15 (step 138). The MFP 11 checks with the paper sensor 29 whether printed paper is left in the theft prevention paper discharge tray 19. When printed paper is not left in the theft prevention paper discharge tray 19 (step 139: Y), the MFP 11 locks the theft prevention paper discharge tray 19 again, then resumes the printing (steps 140 and 141), and executes the print processing in step 110 and the subsequent steps shown in FIG. 13.

On the other hand, when printed paper is left in the theft prevention paper discharge tray 19 (step 139: N), the theft prevention paper discharge tray 19 is locked (step 142). The MFP 11 displays, on the control panel (CP) 36, a request for taking out the printed paper from the theft prevention paper discharge tray 19 (step 143) and notifies the PC 12 at the print request source of the request for taking out the printed paper (step 144). The printing person who has received the notification of the request for taking out the printed paper returns to step 133, inputs the ID number from the control panel (CP) 36, and unlocks the theft prevention paper discharge tray 19 (steps 133 and 134). The printing person pulls out the theft prevention paper discharge tray 19 from the housing 15 and takes out the printed paper left in this theft prevention paper discharge tray 19 (steps 135 and 136). After this, the printing person stores the theft prevention paper discharge tray 19 in the predetermined position in the housing 15 again (step 137). When the printing person confirms that the theft prevention paper discharge tray 19 is surely stored in the predetermined position and printed paper is not left in the theft prevention paper discharge tray 19 (steps 138 and 139), the printing person resumes printing after locking the theft prevention paper discharge tray 19 (steps 140 and 141) and executes the print processing in step 110 and the subsequent steps shown in FIG. 13 until the printing is finished (step 124).

Operations in the case in which printing is performed simultaneously using the standard paper discharge tray 23 and the theft prevention paper discharge trays 19 will be explained according to FIG. 15.

It is assumed that print jobs accepted by the MFP 11 are three print jobs, namely, a print job 1 for output to the standard paper discharge tray 23 shown in FIG. 8, a print job 2 for print output to the theft prevention paper discharge tray 19A at the upper stage, and a print job 3 for print output to the theft prevention paper discharge tray 19B at the next stage. These print job 1, print job 2, and print job 3 are simultaneously executed in time division and printing is alternately performed for one piece of paper in every job.

Figure 15:
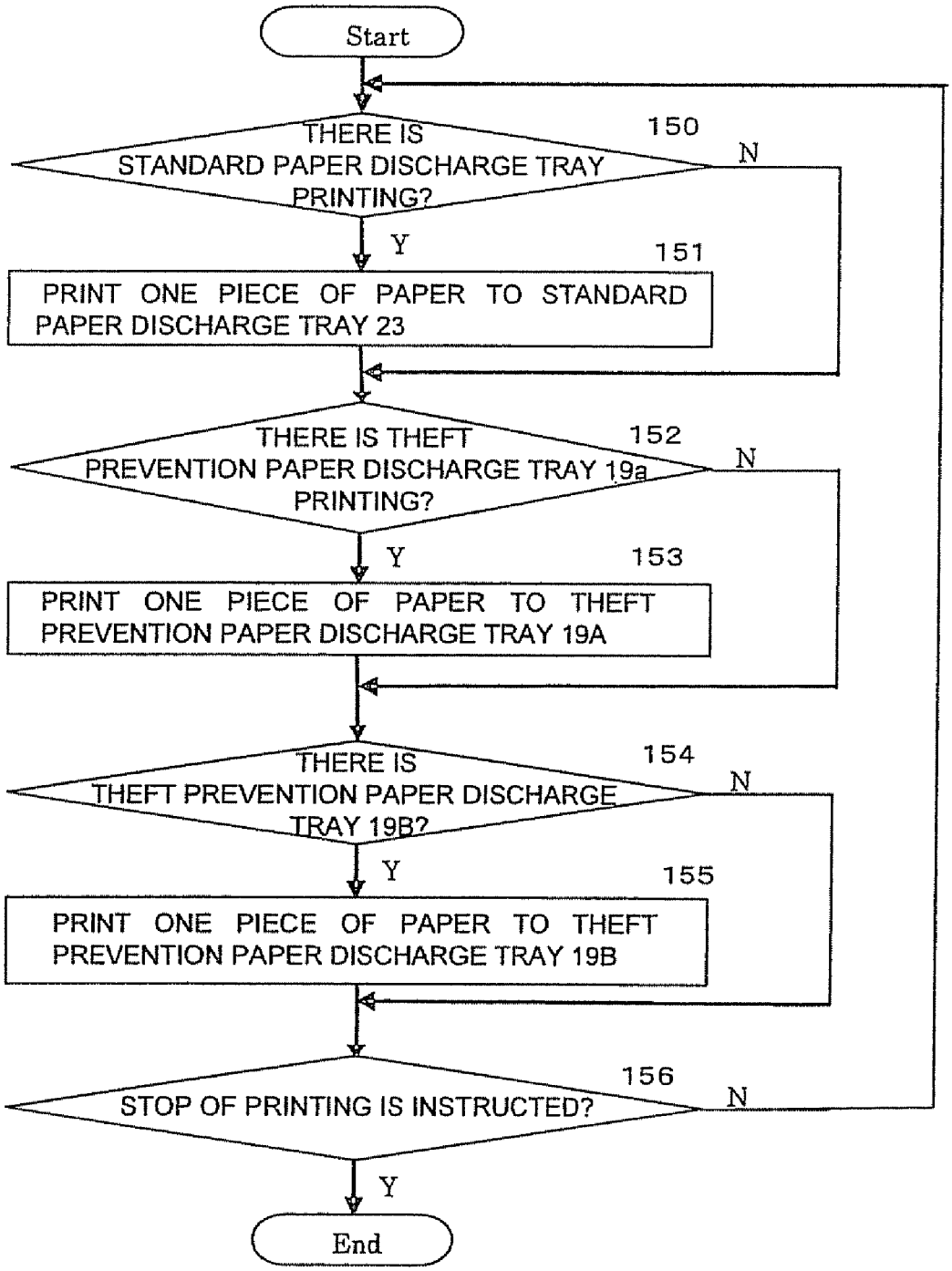
FIG. 15 is a flowchart for explaining a parallel printing operation for plural jobs of the image forming apparatus according to the first embodiment of the invention.

In FIG. 15, first, the MFP 11 checks whether there is printing for output to the standard paper discharge tray 23 (step 150). When there is printing for output to the standard paper discharge tray 23 (step 150: Y), at a point when print output of one piece of paper to the standard paper discharge tray 23 is finished (step 151), the MFP 11 checks whether there is printing for output to the theft prevention paper discharge tray 19A (step 152). When there is no printing for output to the standard paper discharge tray 23 (step 150: N), the MFP 11 immediately checks whether there is printing for output to the theft prevention paper discharge tray 19A (step 152).

When there is printing for output to the theft prevention paper discharge tray 19A (step 152: Y), at a point when print output of one piece of paper to the theft prevention paper discharge tray 19A is finished (step 153) the MFP 11 checks whether there is printing for output to the next theft prevention paper discharge tray 19B (step 154). When there is no printing for output to the theft prevention paper discharge tray 19A (step 152: N), the MFP 11 immediately checks whether there is printing for output to the next theft prevention paper discharge tray 19B (step 154).

When there is printing for output to the theft prevention paper discharge tray 19B (step 154: Y), at a point when print output of one piece of paper to the theft prevention paper discharge tray 19B is finished (step 155) the MFP 11 checks whether there is a print stop instruction (by input from the control panel 36 or the like) (step 156). When there is a print stop instruction (step 156: Y), the MFP 11 stops all the print jobs and finishes the printing. When there is no print stop instruction (step 1506: N), the MFP 11 returns to step 150 and repeats the processings to step 156.

According to the processing described above, printed paper is alternately outputted to the respective paper discharge trays 23, 19A, and 19B.

In this way, when print output to the respective paper discharge trays 23, 19A, and 19B corresponding to plural print jobs is alternately performed, it is possible to reduce a waiting time for the jobs other than the job being performed. When print output is not alternately performed, for example, during execution of a print job that uses the theft prevention paper discharge tray 19A, print jobs that use the standard paper discharge tray 23 and another theft prevention paper discharge tray 19B are in a waiting state. When a large volume of printing is performed in the print job that uses the theft prevention paper discharge tray 19A, the other print jobs do not wait for a long time. On the other hand, when it is possible to alternately perform print output to the respective paper discharge trays 23, 19A, and 19B as described above, it is possible to perform the plural print jobs in parallel. Therefore, the other print jobs do not wait for a long time. It is possible to reduce a waiting time of the jobs other than the job being performed.

In the flowchart in FIG. 15, print output to the respective paper discharge trays is changed for one piece of paper. However, as setting of the number of pieces of paper to be outputted, it is possible to set an arbitrary number in a unit of plural trays with the control panel 36 of the MFP 11.

FIGS. 8, 9, and 10 shows paper paths at the time when printed paper is outputted to the respective paper discharge trays 23, 19A, and 19B. The operations in FIG. 15 described above are realized by changing the paper paths in FIGS. 8, 9, and 10 for each print job.

FIG. 8 shows a case in which the printed paper 25 is print-outputted onto the standard paper discharge tray 23. In this case, as described above, the printed paper 25 delivered from the heat roller 18 is guided to an upper side in the figure by the first selection plate 21*a* of the guiding mechanism 21 and print-outputted onto the standard paper discharge tray 23 through the upper side of this first selection plate 21*a*.

FIG. 9 shows a case in which the printed paper 25 is print-outputted to the theft prevention paper discharge tray 19A at the upper stage. In this case, the printed paper 25 that has passed the heat roller 18 is turned downward by the first selection plate 21*a* of the guiding mechanism 21, further guided to the theft prevention paper discharge tray 19A by the second selection plate 21*b*, and inserted into the theft prevention paper discharge tray 19A.

FIG. 10 shows a case in which the printed paper 25 is print-outputted to the theft prevention paper discharge tray 19B at the next stage. In this case, as in the above case, the printed paper 25 that has passed the heat roller 18 is turned downward by the first selection plate 21*a* of the guiding mechanism 21 and further guided downward as it is by the second selection plate 21*b*. The printed paper 25 is guided to the theft prevention paper discharge tray 19B by the third selection plate 21*c* and inserted into the theft prevention paper discharge tray 19B.

FIG. 11 shows a case in which the printed paper 25 is print-outputted to further below the theft prevention paper discharge tray 19B at the next stage. In this case, the printed paper 25 that has passed the heat roller 18 is turned downward by the first selection plate 21*a* of the guiding mechanism 21. After that, the printed paper 25 is guided further downward by the second selection plate 21*b* and the third selection plate 21*c*. The printed paper 25 is print-outputted to further below the theft prevention paper discharge tray 19B at the next stage.

A case in which a jam has occurred in the inside of the MFP 11 will be explained using FIG. 12.

FIG. 12 shows a state in which jams has occurred in the entrance section (the section of the second selection plate 21*b*) of the theft prevention paper discharge tray 19A at the upper stage and the entrance section (the section of the third selection plate 21*c*) of the theft prevention paper discharge tray 19B at the next stage, respectively. These jams are detected by the second jam sensors 32 provided in the entrance sections of the theft prevention paper discharge trays 19A and 19B. In this case, if it is confirmed by the first jam sensor 31 that a jam has not occurred in the exit section of the heat roller 18, it is possible to partially continue printing. The jams in the entrance sections of the theft prevention paper discharge trays 19A and 19B make print output to these theft prevention paper discharge trays 19A and 19B impossible but do not stop print output to the standard paper discharge tray 23. Therefore, although the jams have occurred, it is possible to continue print output to the standard paper discharge tray 23 in which a jam has not occurred.

In this way, when the jams have occurred in the sections of the theft prevention paper discharge trays 19A and 19B, it is impossible to perform processing for removing the jams unless the ID number is inputted from the control panel 36 to unlock the theft prevention paper discharge trays 19A and 19B. This is for the purpose of preventing theft of printed paper that is printed before the jams occur. However, in the case shown in FIG. 12, since print output to the normal paper discharge tray 23 is possible, it is inefficient to keep print output to the standard paper discharge tray 23 stopped until the jams are removed in the theft prevention paper discharge tray 19A and the theft prevention paper discharge tray 19B. Thus, even if the jams have occurred during print output to the theft prevention paper discharge trays 19A and 19B, if the jams are jams not affecting print output to the normal paper discharge tray 23 as in FIG. 12, it is possible to perform print output even if the jams are not removed. In this way, useless print pause is prevented and deterioration in printing efficiency is prevented.

When a jam has occurred in the exit section of the heat roller 18, since it is unnecessary to pull out the theft prevention paper discharge trays 19A and 19B, even a user who does not know the ID number can remove the jam. Therefore, it is possible to immediately remove the jam and resume the printing (including the printing that uses the theft prevention paper discharge trays 19A and 19B).

In FIG. 12, the output of the printed paper to the standard paper discharge tray 23 at the time when the jams have occurred in the sections of the theft prevention paper discharge trays 19A and 19B is explained. Conversely, when a jam has occurred on the standard paper discharge tray 23 side, it is also possible to execute printing if print output to the side of the theft prevention paper discharge trays 19A and 19B is possible. When a jam has occurred in the theft prevention paper discharge tray 19A or 19B, print output to the theft prevention paper discharge tray in which the jam has not occurred is also possible.

What is claimed is:

1. An image forming apparatus with a printed-paper storing function, comprising:

a housing;

a printing unit configured to be provided in this housing;

a printed-paper storing unit configured to be provided in the housing to be removable to an outside and store paper printed by the printing unit;

a guiding mechanism that guides the paper printed by the printing unit to the printed-paper storing unit;

a fixing mechanism that fixes the printed-paper storing unit in a lock state for physically preventing removal to the outside of the housing; and a control unit configured to cause, when a print job designating internal storage of a print result from a user side is accepted, the fixing mechanism to operate to enter the lock state, notify the user side of an unlock number of a number selected at random, cause the printing unit to operate in accordance with the print job, after printing is finished, notify the user side of the finish of the printing, and release, when the unlock number is inputted, the lock state by the fixing mechanism;

wherein the control unit alternately executes, when a print job designating internal storage of a print result and a print job not designating the internal storage are accepted, these print jobs for each predetermined number of pieces of paper and causes the guiding mechanism to guide printed paper to the printed-paper storing unit corresponding thereto only during execution of a print job designating the internal storage of a print result.

2. An image forming apparatus with a printed-paper storing function according to claim 1, wherein when a print job designating internal storage of a print result is accepted, the control unit controls, for one print job within a number of stored pieces of paper in one paper storing unit, a fixing mechanism corresponding to this paper storing unit to be in the lock state only once.

3. An image forming apparatus with a printed-paper storing function according to claim 1, wherein a plurality of the printed-paper storing units are provided in the housing, and the control unit allocates, when plural print jobs designating internal storage of a print result are accepted, one paper storing unit for each print job, controls a fixing mechanism corresponding to the paper storing unit allocated to be in the lock state and brings this paper storing unit into a use state, and then disallows use of the paper storing unit by other print jobs until the lock state by this fixing mechanism is released.

4. An image forming apparatus with a printed-paper storing function according to claim 1, wherein the fixing mechanism brings the printed-paper storing unit into the lock state for physically preventing removal to the outside of the housing according to turning-off of a main power supply to a main body unit including the printing unit and releases the lock state according to turning-on of the main power supply.

5. An image forming apparatus with a printed-paper storing function according to claim 1, wherein the control unit has a removal detecting unit configured to detect that the printed-paper storing unit is removed to the outside of the housing and, when the printed-paper storing unit is in the lock state by the fixing mechanism, sounds an alarm device when the removal detecting unit operates.

6. An image forming apparatus with a printed-paper storing function according to claim 5, wherein the removal detecting unit and the alarm device are supplied with electric power by a power supply that is capable of supplying electric power even if the main power supply is turned off.

7. An image forming apparatus with a printed-paper storing function according to claim 1, wherein the control unit notifies, when a print job designating a number of prints exceeding a number of pieces of stored paper of the printed-paper storing unit is accepted, a user side who transmitted this print job that the number of prints of this print job is a value exceeding the number of pieces of stored paper of the printed-paper storing unit.

8. An image forming apparatus with a printed-paper storing function according to claim 1, wherein the control unit notifies, when a print job accepted designates a number of prints exceeding a number of pieces of stored paper of the printed-paper storing unit, a user side who transmitted this print job that a number of prints has reached a predetermined number of pieces of paper within the number of pieces of stored paper.

9. An image forming apparatus with a printed-paper storing function according to claim 1, wherein the printed-paper storing unit has a paper sensor that detects whether printed paper is present in an inside thereof, and the control unit stops, when a print job accepted designates a number of prints exceeding a number of pieces of stored paper of the printed-paper storing unit, printing when a number of prints reaches a predetermined number of pieces of paper within the number of pieces of stored paper, releases the lock state of the printed-paper storing unit by the fixing mechanism according to input of the unlock number, and causes, when the paper sensor detects that no printed paper is present in the paper storing unit set in a predetermined position in the housing, the fixing mechanism to lock the printed-paper storing unit corresponding thereto.

10. An image forming apparatus with a printed-paper storing function according to claim 1, wherein a plurality of the printed-paper storing units are provided in the housing, the printing unit has a first jam sensor that detects a jam of printed paper, the plural printed-paper storing units respectively have second jam sensors that detect a jam of paper stored, and the control unit executes, when the first jam sensor has not detected a jam and any one of the second jam sensors has detected a jam, a print job to which the printed-paper storing unit having the second jam sensor, which has not detected a jam, is allocated.

11. A printed-paper storing method of an image forming apparatus, comprising the steps of:

alternately executing, when a print job designating internal storage of a print result and a print job not designating the internal storage are accepted from a user side, these print jobs for each predetermined number of pieces of paper and causing a guiding mechanism to guide printed paper to a printed-paper storing unit corresponding thereto only during execution of a print job designating the internal storage of a print result;

causing, when a print job to be executed is a print job designating internal storage of a print result, a fixing mechanism, which is operable to a lock state for physically preventing removal to an outside of a printed-paper storing unit configured to be removable to the outside, to operate to enter the lock state;

notifying, when the fixing mechanism comes into the lock state, the user side of an unlock number of a number selected at random;

causing the printing unit to operate in accordance with the print job after the notification of the unlock number;

notifying, when the print operation based on the print job is finished, the user side of the finish of the printing; and releasing the lock state by the fixing mechanism when the unlock number is inputted.

12. A printed-paper storing method of an image forming apparatus according to claim 11, wherein, when the print job designating internal storage of a print result is within a number of pieces of stored paper of one paper storing unit, a number of times the fixing mechanism for this paper storing unit is caused to operate to enter the lock state is only once for one print job.

13. A printed-paper storing method of an image forming apparatus according to claim 11, wherein, when plural print jobs designating internal storage of a print result are accepted, one paper storing unit for each print job is allocated to a plurality of the printed-paper storing units provided, and, when a fixing mechanism corresponding to the paper storing unit allocated comes into the lock state, use of the paper storing unit by other print jobs is disallowed until the lock state by this fixing mechanism is released.

14. A printed-paper storing method of an image forming apparatus according to claim 11, wherein the operation to enter the lock state of the fixing mechanism is performed according to turning-off of a main power supply to a main body unit including the printing unit and the lock state is released according to turning-on of the main power supply.

15. A printed-paper storing method of an image forming apparatus according to claim 11, wherein, when the printed-paper storing unit is in the lock state by the fixing mechanism, an alarm device is sounded when this printed-paper storing unit is removed to the outside.

16. A printed-paper storing method of an image forming apparatus according to claim 15, wherein the sounding of the alarm device is executed by a power supply that is capable of supplying electric power even if the main power supply is turned off.

17. A printed-paper storing method of an image forming apparatus according to claim 11, wherein, when a print job accepted designates a number of prints exceeding a number of pieces of stored paper of the printed-paper storing unit, it is notified to a user side who transmitted this print job that the number of prints of this print job is a value exceeding the number of pieces of stored paper of the printed-paper storing unit.

18. A printed-paper storing method of an image forming apparatus according to claim 11, wherein, when a print job accepted designates a number of prints exceeding a number of pieces of stored paper of the printed-paper storing unit, it is notified to a user side who transmitted this print job that a number of prints has reached a predetermined number of pieces of paper within the number of pieces of stored paper.

* * * * *